US005428423A

United States Patent [19]

Clark

[11] Patent Number: 5,428,423

[45] Date of Patent: Jun. 27, 1995

[54] PHOTOGRAPHIC PRINTED CARDS AND APPARATUS AND METHOD OF MAKING SAME

[76] Inventor: John R. Clark, 1415 Lombard Ave., Everett, Wash. 98201

[21] Appl. No.: 153,492

[22] Filed: Nov. 17, 1993

Related U.S. Application Data

[63] Continuation-in-part of Ser. No. 8,076, Jan. 22, 1993, abandoned, which is a continuation of Ser. No. 798,163, Nov. 26, 1991, abandoned.

[51] Int. Cl.[6] ..... G03B 27/32

[52] U.S. Cl. ..... 355/77; 229/92.8; 355/40

[58] Field of Search ..... 355/27, 40, 41, 50, 355/39, 77, 133; 229/92.8

[56] References Cited

U.S. PATENT DOCUMENTS

| | | | |
|---|---|---|---|
| 725,963 | 4/1903 | Hoffmann | 229/92.8 |
| 817,663 | 4/1906 | Pifer | 229/92.8 |
| 3,259,304 | 7/1966 | Tichnor | 229/92.8 |
| 3,726,471 | 4/1973 | Kalb | 229/92.8 |
| 4,079,881 | 3/1978 | Sabb . | |
| 4,237,633 | 12/1980 | Murrell . | |
| 4,629,312 | 12/1986 | Pearce et al. | 355/29 |
| 4,662,093 | 5/1987 | Suttles et al. . | |
| 4,823,163 | 4/1989 | Rollet et al. | 355/41 |
| 4,947,566 | 8/1990 | Hoebel . | |
| 4,953,780 | 9/1990 | Ross . | |
| 5,023,655 | 6/1991 | Hicks | 355/39 |
| 5,072,253 | 12/1991 | Patton | 355/77 |
| 5,085,470 | 2/1992 | Peach et al. | 229/92.8 |

*Primary Examiner*—Richard A. Wintercorn
*Attorney, Agent, or Firm*—Graybeal Jackson Haley & Johnson

[57] ABSTRACT

A method for making photographic cards by imprinting a message directly on the reverse side of a photograph, in a plurality of configurations including singular cards, cards in sheet form, cards in roll form and cards in a new and improved continuous form with tractor feed selvedge strips and perforations for separating the photographs from each other and from the selvedge strips. Each configuration of photographic cards is comprised of developed photographs having a photographic image surface (32) on one side and a message printed directly on an imprinting surface (34) which is the reverse side of the photographic paper material (30) using a computer (22) with a printer (24) attached and controlled by a software (20) program used by a computer operator (18) to create and edit messages and control the printing of said messages. The resulting photographic card can be used for picture postcards for a plurality of different kinds of applications including; direct mail advertising, personal greeting cards for holidays, notices for family events of many different kinds and photographic identification and filing cards for all conceivable types of applications.

19 Claims, 6 Drawing Sheets

PHOTOGRAPHIC PRINTED CARDS AND APPARATUS AND METHOD OF MAKING SAME

This application is a Continuation-in-Part of Ser. No. 08/008,076, filed Jan. 22, 1993, which is a Continuation of Ser. No. 07/798,163, filed Nov. 26, 1991, both applications now abandoned.

BACKGROUND

1. Field of the Invention

This invention relates to photographic cards with a picture on one side and a printed message on the reverse side, specifically picture post cards for a plurality of applications including advertising postcards and other forms of postcards, personal greeting cards, photographic fie and identification cards. This invention also relates to the method used to process and imprint the photographic cards and the photographic paper material used for making same.

2. Description of Prior Art

Conventional picture postcards have been used for advertising and many other purposes for many years and the method for making these postcards is public domain information. Conventional picture postcards consist of a sheet of rigid paper material having a printed picture on one side and a printed message on the other side with space for addressing and postage. The method used to make conventional picture postcards is the traditional printing press using typesetting procedures and a number of color separations for printing color photographs. A very large quantity (on the order of tens of thousands) of cards of a single subject and message must be printed, to justify the cost of the color separations and use of the traditional typeset method of printing.

This type of mass produced postcard is very popular for tourist attractions and for certain advertising applications for mass markets. However, many small businesses and individuals cannot justify the cost of printing these postcards for more personal uses or for specific small quantity (under ten thousand) advertising purposes. Since 1973, several unique methods for making picture postcards have been invented to attempt to solve these problems. Each of these methods for making picture postcards proposed to date suffer from a major shortcoming, thereby limiting their commercial value. They all require some degree of assembly using two or more pieces. The most recent being U.S. Pat. No. 4,953,780 to Ross (Sep. 4, 1990) which shows a card covered with adhesive, a protective sheet and a border. U.S. Pat. No. 4,947,566 to Hoebel (Aug. 14, 1990) shows a similar construction with a portion of one panel using a folded easel. U.S. Pat. No. 4,662,093 to Suttles and Madsen (May 5, 1987) and U.S. Pat. No. 4,237,633 to Murrell (Dec. 9, 1980) both show folded hinged panels for holding photographs in place. U.S. Pat. No. 4,079,881 shows a construction technique using a clear plastic sheet to hold a photograph in place.

The problem of requiring assembly of a plurality of pieces as shown in the prior art, drastically limits the use of these picture postcards for a number of individual applications such as small quantity, direct mail advertising. The labor cost for assembly is prohibitive for a member of different types of applications and it would be highly advantageous to remedy this deficiency in the prior art. Imprinting the message directly on the reverse surface of a photograph, thereby negating any requirements for assembly of separate pieces, would drastically reduce the costs for producing the photographic cards. Also, the image quality of the photograph itself would be much better than any printed color separations, and the cost for processing and printing the color separations would be eliminated. In addition, the requirement for printing separate name and address mailing labels can be eliminated, thereby further reducing the extra materials and labor costs revolved. Very small quantities of advertising postcards and personal greeting cards could be cost justified using the method for imprinting and the photographic paper material of this invention.

SUMMARY OF THE INVENTION

Accordingly, one aspect of the present invention is to use the reverse side of a photograph as the imprinting surface for a message, thereby eliminating any need for assembly of pieces and the cost of labor involved thereof. The configuration of photographs can be in singular form, in sheet form or in one era plurality of continuous form configurations.

Another aspect of this invention is to have the capability of printing the name and address information and a postal permit number along with the message all in one operation, thereby eliminating the need for generating separate mailing labels, and the additional need for applying postage.

Another very important and unique aspect of the present invention is a method for imprinting a message on a plurality of photographic cards, in one continuous operation, using a new and improved, continuous form, photographic paper material. This new photographic paper material will be manufactured with selvedge strips on each edge of the material. The selvidge strips will contain sprocket holes for engaging the tractor feed mechanisms of printing machines. This new photographic printing paper will also contain perforations to allow for separation of the selvedge strips from the photographs and separation of the individual photographic cards from each other. This tractor feed method allows for the accurate control and registration of the photographic printing paper while it is being processed by a printing machine. The printing machine is then controlled by a computer utilizing software used by a computer operator for writing and editing messages and mail merging those messages with names and addresses.

And another aspect of the invention is to provide an inexpensive method for small businesses to use a color photograph of their product to generate direct mail advertising photographic cards and product news release photographic cards. For instance, the small business operator could take a color picture of a new product the business has developed using one of a plurality of different types of cameras including the popular SLR 35 mm cameras, have the film processed or develop the film in-house and use the negative to print the color photographs on the new and improved photographic paper of this invention. The small business operator could then direct the advertising message to specific targeted consumers or industries and change the message at will by using the method of this invention for imprinting the message directly on the reverse side of the photograph. This job can be accomplished using one of a plurality of different types of computers including mainframe, mini and personal computers and one of a plurality of different types of printers including laser, ink jet or dot matrix and other types of printers. The small business operator could also send the cards to the approximately 1600 magazines and newspapers in this country as news releases. A color photograph with a description and advertising message imprinted directly on the reverse side of the photograph would be ideal for product news releases in the small quantifies required. The quantities involved would not justify the use of the traditional typeset printing method because of the excessive costs of that method and with conventional methods of printing, the message could not be edited at will, for different applications or markets for that new product And still another aspect of the invention is to provide an inexpensive method for individuals to generate personal photographic greeting cards for holidays and special family events such as engagements, weddings, family reunions, vacations, etc. An example would be taking a picture of the family holding a banner with the words "Merry Christmas" on it, having the film developed and color prints made using the photographic printing paper material of this invention, imprinting a Christmas message on the back of the continuous form photographs using their personal computer and printer, and mailing one of the finished photographic cards to each of their relatives and friends in place of commercial Christmas Cards. This would be a much more personal and a considerably warmer way to send greeting cards for holidays and the cost of using the method and material of this invention would be one fourth of the cost of commercial greeting cards.

Yet another aspect of the invention is to provide an inexpensive method of generating photographic cards for identification and filing purposes such as, photograph identification cards for company employees, mug shots for police departments, file cards for collector items, identification cards for plants, mammals and inanimate objects for scientific purposes, etc. For example, a botanist discovers a new type of plant and needs a way to distribute a color photograph and description of the plant to other interested botanists around the world. The small quantity of photographic cards needed for this application would not justify the cost of conventional typesetting and color printing and the logical choice would be to use the method and material of this invention to distribute the photographic cards.

And a further aspect of the invention is to provide a photographic card for any conceivable application where a method is needed for imprinting a message directly on the back of a photograph, utilizing a computer with a printer attached and software for creating the sage. Still further features and advantages of the present invention win be apparent from the drawings and descriptions provided.

DETAILED DESCRIPTION—FIGS. 1 THROUGH 18

Figure 1:
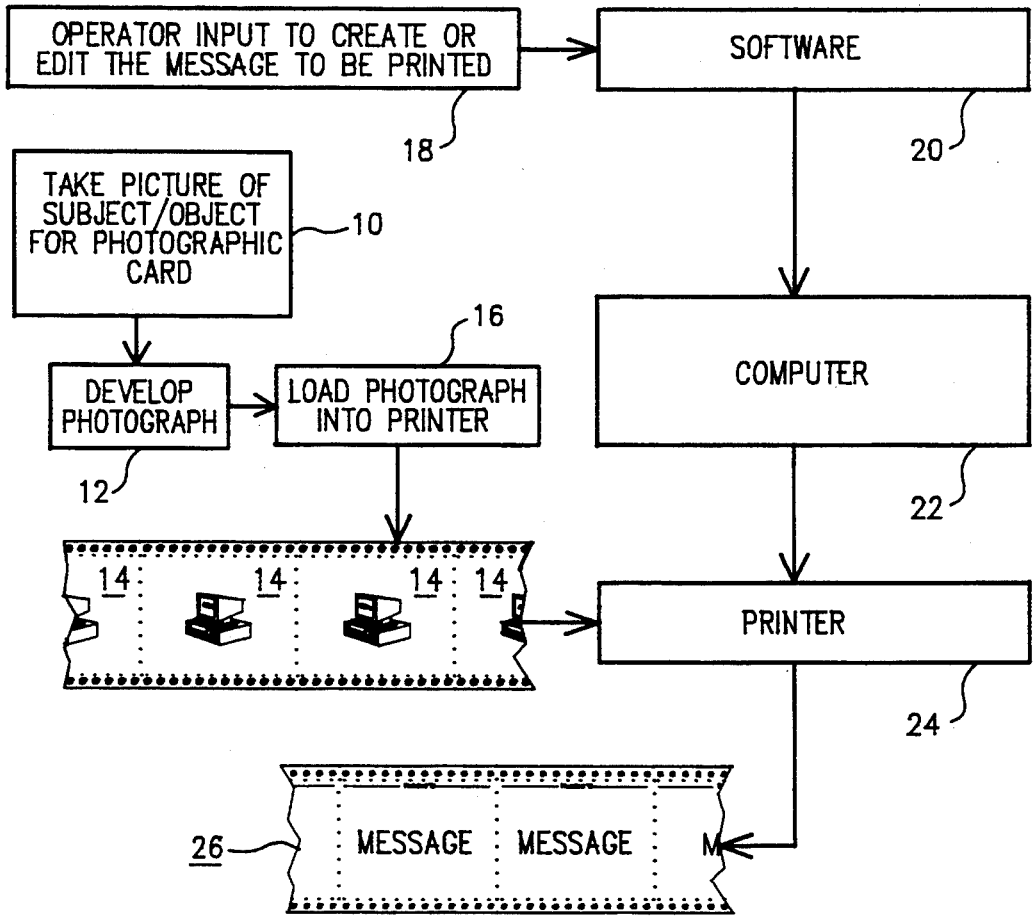
FIG. 1 shows a flow chart which illustrates the method used for printing a message directly on the imprinting surface of a photograph to make a photographic card.

The flow chart of FIG. 1 illustrates each step of the method of this invention for making photographic cards for use as postcards, greeting cards, identification cards and file cards. The first step (10) of the method is taking a photograph of a subject/object for the photographic card using one of a plurality of different types of cameras. In the next step (12) the film is developed to obtain a negative of the photograph and the negative is then used to print photographs on the new and improved photographic printing paper of this invention or other configurations of photographic printing paper as shown in FIGS. 8 through 15. Alternatively, the photographs can be printed on the photographic print paper according to a positive photographic process, in contrast to the negative photographic process described above. In the next step (16) the preferred embodiment of the plurality of continuous form photographs (14) as illustrated in FIGS. 2 through 7 is then loaded into the tractor feed mechanism of the printing machine (24) which is controlled by the computer (22) which is controlled by the software program (20) which is used by the computer operator (18) to create and edit the message to be imprinted on the imprinting surface of the photographic card. The completed photographic card (26) that is the result of the method and material of this invention is then removed from the printer. The printing machine (24) can be one of a plurality of different types, including but not limited to impact printers, laser printers and inkjet printers. The computer (22) can be one of a plurality of different types including but not limited to mainframes, minis and personal computers.

Figure 17:
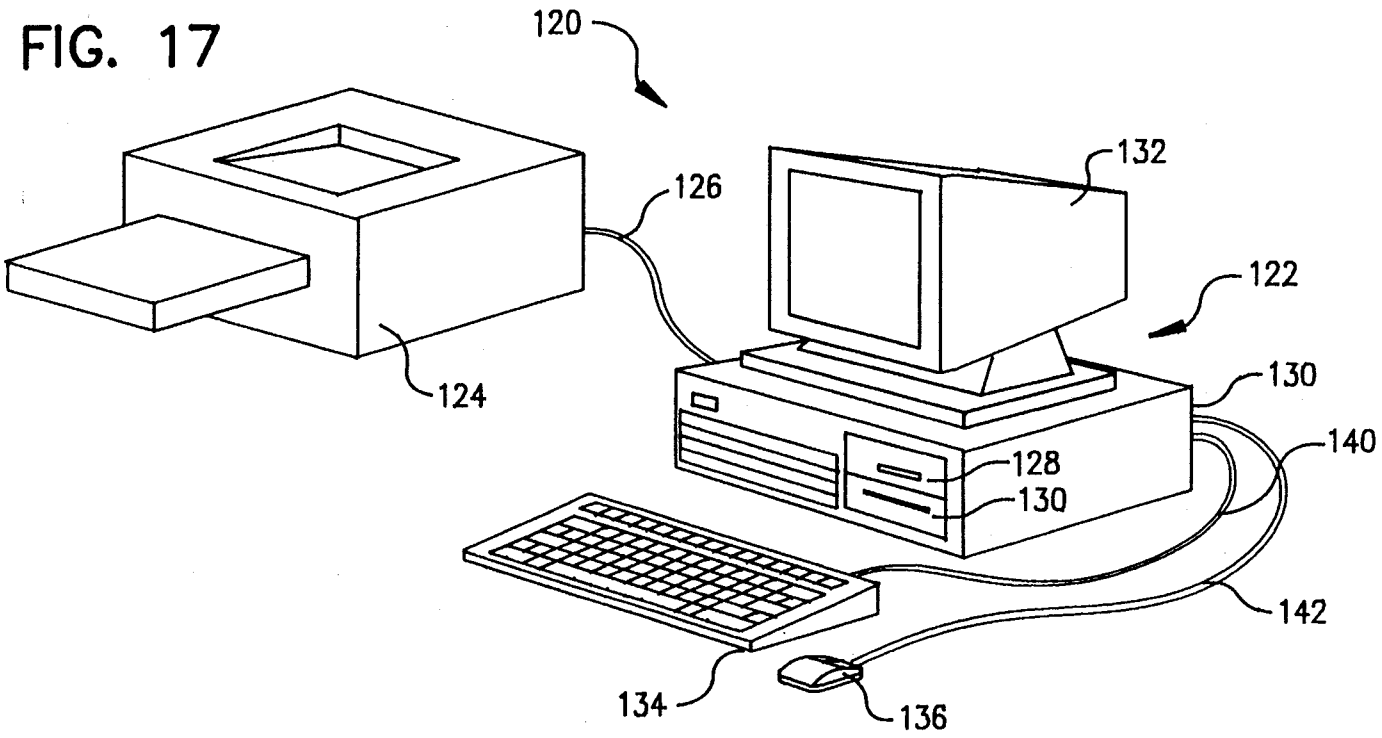
FIG. 17 is a schematic diagram of a preferred embodiment of a computer and printer system comprising the claimed apparatus, for performing the claimed method and producing the claimed card stock.

FIG. 17 is a schematic diagram of a preferred embodiment of a computer and printer system comprising the claimed apparatus, for performing the claimed method and producing the claimed card stock. The computer and printer system 120 includes a computer 122 and a printer 124. The printer 124 is connected to the computer 122 through a cable 126. The computer 122 is a conventional IBM PC-compatible computer based on an Intel 80486 microprocessor operating at a clock speed of 33 MHz. The computer 122 includes 8 Mb of conventional random-access memory (RAM) for storage of data such as information data which can be printed on the non-photographic side of the photographic printing paper. The computer 122 also includes a conventional 213 Mb hard drive for storage of a computer operating system and software to implement the claimed method. The computer 122 further includes a 3.5 inch floppy disk drive 128 and a 5.25 inch floppy disk drive 130 for insertion of information data from sources external to the computer 122.

The computer 122 further includes a display 132, a keyboard 134, and a pointing device 136. The display 132 is a conventional SVGA display, having a 17 inch diagonal measurement, such as model Viewsonic 7, made by Viewsonic. The display 132 is connected to the computer chassis 138 through a conventional cable (not shown). The keyboard 134 is conventional and is connected to the computer chassis 138 through a cable 140. The pointing device 136, which may be a Logitech serial mouse, is connected to the computer chassis 138 through a cable 142.

The printer 124 is a conventional C. Itoh laser printer, having a printing capacity of 8 sheets (8.5-inch by 11-inch size) per minute. Alternatively, the printer 124 can be a conventional dot matrix printer having a roller pin-drive tractor feed. The printer 124 can be caused to print many desired formats of the information data on the back of the photographic printing paper, including a format for four photographs per sheet and a format for ten photographs per sheet.

The computer 122 operates under the operating system known as Windows 3.1, produced by Microsoft Corporation of Redmond, Wash. The information data is formatted by a conventional word-processing such as Word for Windows (produced by Microsoft Corporation, Redmond, Wash.) or a newsletter-production program such as Pagemaker (produced by Aldus Corporation, Seattle, Wash.).

Figure 2:
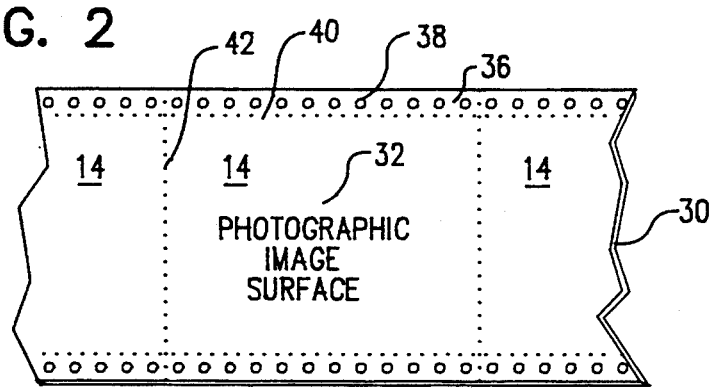
FIG. 2 shows the new and improved, continuous form configuration for photographic printing paper, including the selvedge steps with the sprocket holes for insertion into tractor feed mechanisms in printing machines and the perforations for separating the selvedge strips from the photographs and for separating the photographs from each other.

FIG. 2 illustrates the photographic printing paper material (30) in a new and improved configuration, showing it as the preferred embodiment of this invention as an article of manufacture, with selvedge strips (36) containing sprocket holes (38) for engaging the tractor feed mechanisms of printing machines, the perforations (40) for separating the selvedge strips (36) from the photographs (14) and the perforations (42) for separating the photographs (14) from each other. Also illustrated, is side of the photographic printing paper to be used for the photograph image surface (32).

Figure 3:
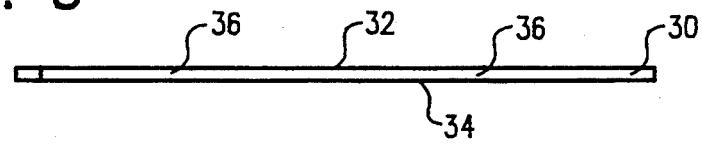
FIG. 3 shows a view of the edge of the photographic card with descriptive numerals indicating the photographic paper material, the photographic image surface and the opposite side thereof for the imprinting surface. Also shown, are the perforations for separating the photographic cards after processing.

FIG. 3 shows a view of the edge of the photographic printing paper material (30) with the photographic image surface (32) shown on the opposite side of the photographic paper material (30) from the imprinting surface (34). The perforations (42) for separating the photographs (14) after they are printed are also shown.

Figure 4:
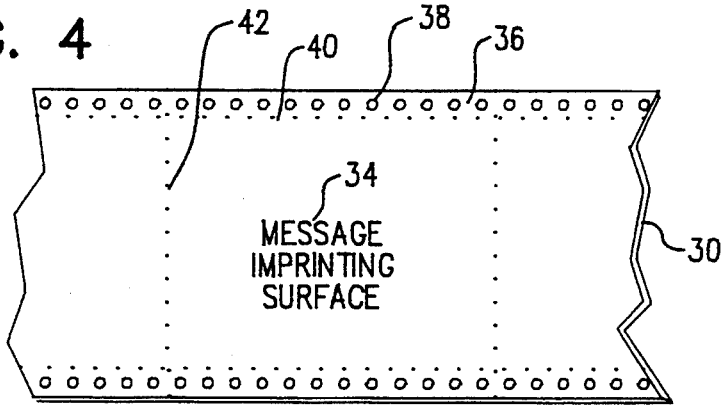
FIG. 4 shows the reverse side of the photographic printing paper material of FIG. 2, the side used for imprinting the message.

FIG. 4 shows the reverse side of the photographic printing paper material (30) of FIG. 2, the side used for imprinting a message on the imprinting surface (34).

Figure 5:
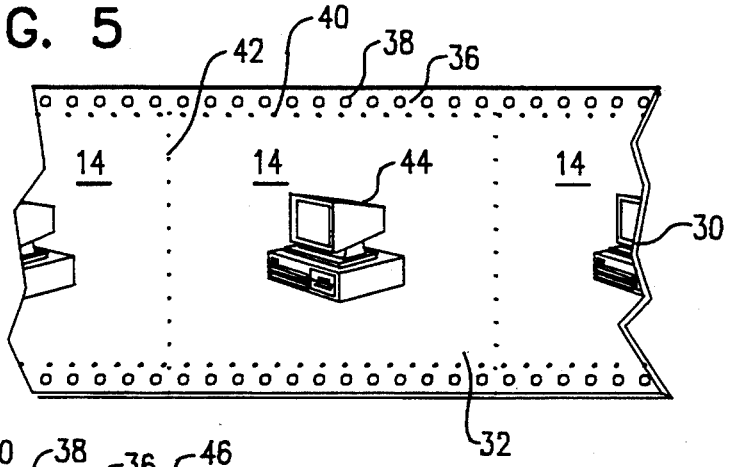
FIG. 5 shows the preferred embodiment for a plurality of photographic cards in the ideal continuous form configuration for imprinting with the photographic image surface illustrated.

FIG. 5 shows the preferred embodiment of continuous form, photographic cards whereby a plurality of photographs (14) are connected with perforations (42) between the photographs (14) as means for separation of the individual photographic cards. The means for tractor feed of the photographs thru a printer is also shown. Said means being the selvedge strips (36) containing the sprocket holes (38) for printer tractor feed mechanisms on each edge of the photographic printing paper material (30). The selvedge strips (36) are made removable by the inclusion of tear-off perforations (40) between the selvedge strips (36) and the photographs (14). The photographic image surface (32) side of the photographic cards is illustrated.

Figure 6:
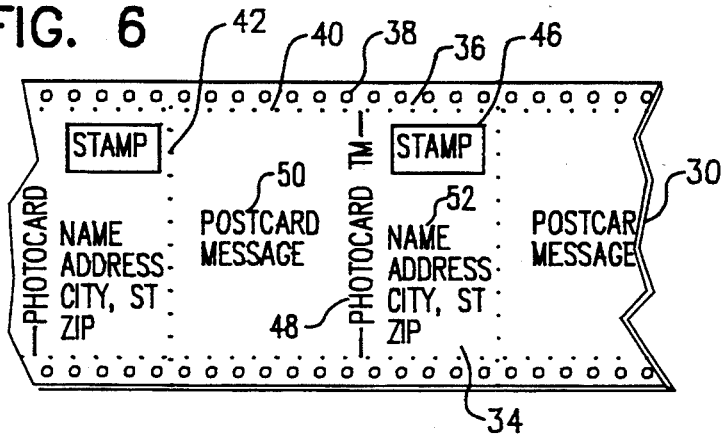
FIG. 6 shows the plurality of the photographic cards of FIG. 4 with the imprinting surface illustrated in the configuration for a post card with separate areas for the message, the name and address information, the postage and trademark information.

FIG. 6 shows the plurality of photographic cards of FIG. 5 with the imprinting surface (34) illustrated in a postcard configuration with separate spaces for the postcard message (50), the name and address (52), the postage or printed postal unit (46) and Trademark (48) information.

Figure 7:
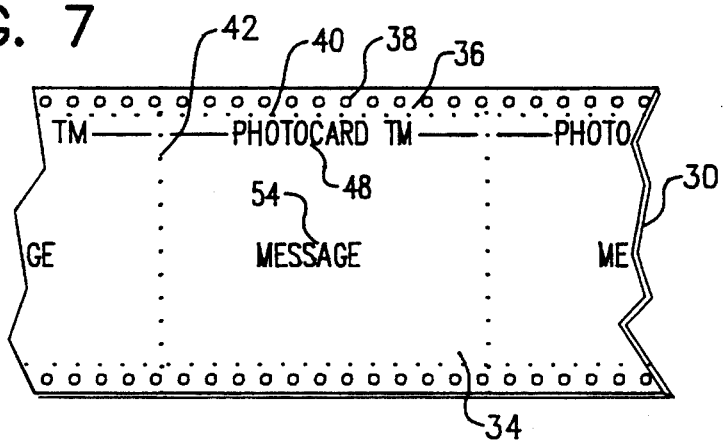
FIG. 7 shows the plurality of the photographic cards of FIG. 4 with the imprinting surface illustrated in the configuration for a file card where the entire imprinting surface is used for the message. Also a small space is indicated for trademark information.

FIG. 7 shows the plurality of photographic cards of FIG. 5 with the imprinting surface (34) illustrated in a file card configuration with the entire imprinting surface (34) used for imprinting the message (54).

Figure 8:
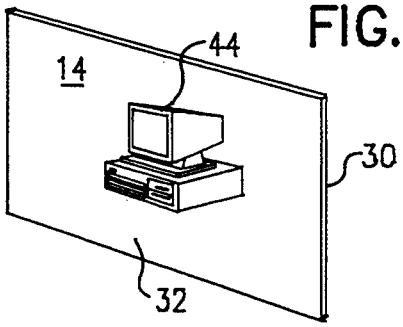
FIG. 8 shows a singular, photographic card with reference numerals describing the photographic image surface, the imprinting surface and the photographic paper material with the photographic image surface illustrated.

A typical embodiment of a photographic card is illustrated in FIG. 8, whereby a singular photograph (14) is shown having a photographic image surface (32) on one side and a imprinting surface (34) on the reverse side of the photographic paper material (30), the photographic image surface (32) being illustrated. The photograph (14) of this configuration can be loaded into a printer manually or with an automatic sheet feeding mechanism.

Figure 9:
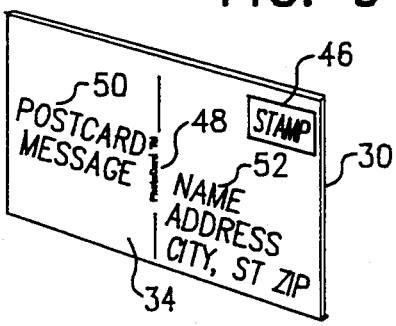
FIG. 9 shows the singular photographic card of FIG. 7 with the imprinting surface illustrated in the configuration for a post card with separate areas for the message, the name and address information, the postage and trademark information.

FIG. 9 has the imprinting surface (34) side of the card of FIG. 7 illustrated with a configuration for a post card with separate areas for the postcard message (50), the name and address information (52), the postage or printed postal permit (46) and trademark (48) information.

Figure 10:
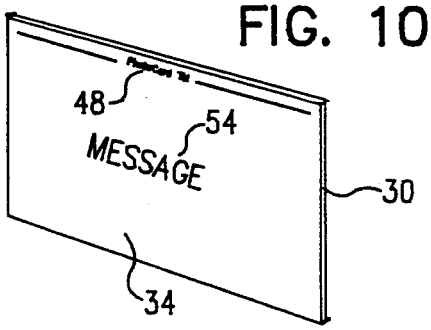
FIG. 10 shows the singular photographic card of FIG. 7 with the imprinting surface illustrated in the configuration for a file card where the entire imprinting surface is used for the message. Also a small space is indicated for trademark information.

FIG. 10 has the imprinting surface (34) side of the card illustrated with a configuration for a file card where the entire imprinting surface (34) is used for the message. Also, space for trademark (48) information is indicated.

Figure 11:
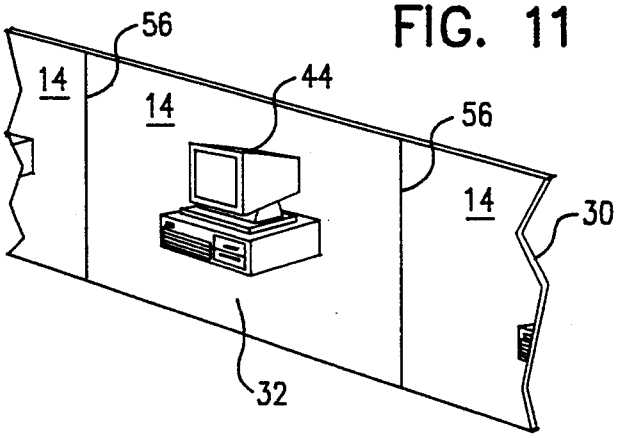
FIG. 11 shows a plurality of photographic cards with the photographs connected in a continuous form configuration without selvedge strips and with the photographic image surface illustrated.

A different embodiment of a plurality of photographic cards is shown in FIG. 11 whereby a plurality of photographs (14) are connected together in continuous roll form. The photographic image surface (32) of the photographic cards is illustrated and is on one side of the photographic paper material (30) and the imprinting surface (34) is indicated on the reverse side thereof. A line of separation (56) between the individual photographs is illustrated.

Figure 12:
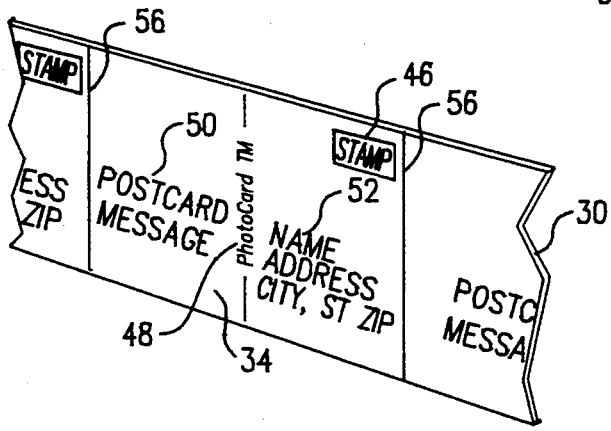
FIG. 12 shows the plurality of photographic cards in the continuous form configuration of FIG. 11 with the imprinting surface illustrated in the configuration for a post card with separate areas for the message, the name and address information, the postage and trademark information.

FIG. 12 shows the plurality of photographic cards of FIG. 11 with the imprinting surface (34) side of the photographs (14) illustrated with a configuration for post cards with separate areas for the postcard message (50), the name and address (52), the postage or printed postal permit (48) and the trademark (48) information.

Figure 13:
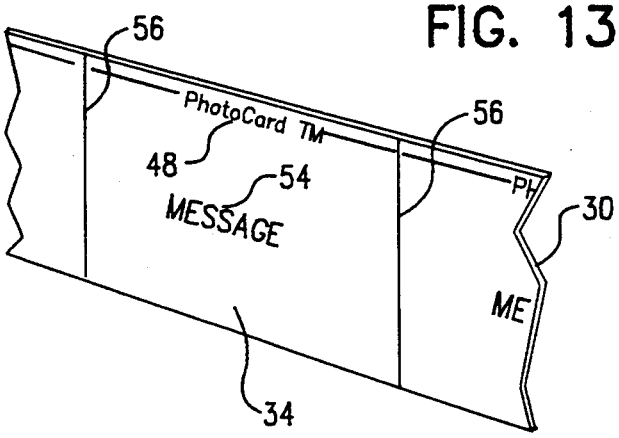
FIG. 13 shows the plurality of photographic cards in the continuous form of FIG. 11 with the imprinting surface illustrated in the configuration for a file card where the entire imprinting surface is used for the message. Also space for trademark information is indicated.

FIG. 13 shows the plurality of photographic cards of FIG. 11 with the imprinting surface (34) side of the cards illustrated with a configuration for a file card where the entire imprinting surface (34) is used for the message. Also, space for trademark (48) information is indicated.

Figure 14:
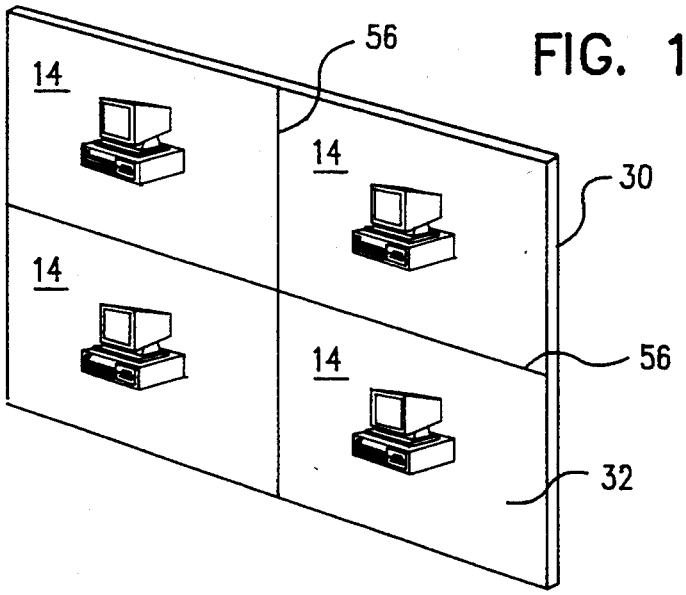
FIG. 14 shows a plurality of photographs on a single sheet with the photographic image surface illustrated.

FIG. 14 shows a plurality of photographs (14) on a single sheet of photographic printing paper material (30) with the photographic image (32) illustrated. Also shown, are the lines of separation (56) between the individual photographs (14).

Figure 15:
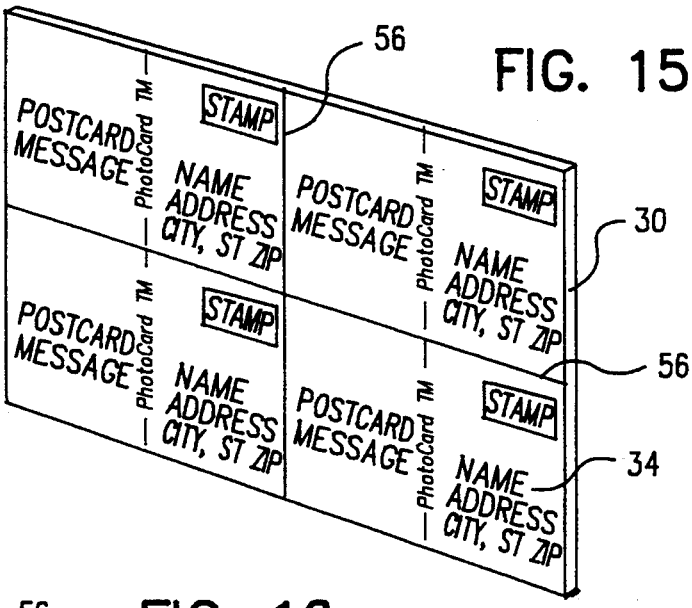
FIG. 15 shows the plurality of photographs of FIG. 14 with the imprinting surface illustrated in a configuration for a postcard.

FIG. 15 shows the plurality of photographs (14) on a single sheet of photographic printing paper material (30) of FIG. 14 with the imprinting surface (34) side illustrated and also shown, is the configuration for a postcard message (50). The lines of separation (56) between each of the individual photographs (14) are also indicated.

Figure 16:
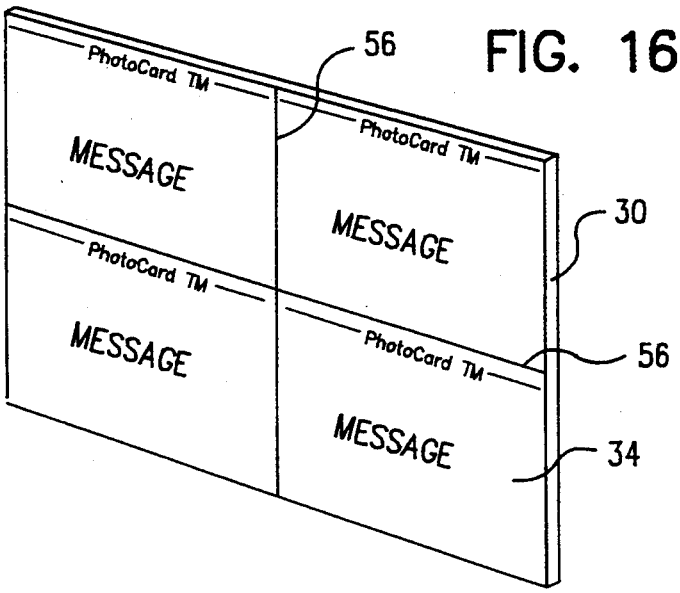
FIG. 16 shows the plurality of photographs of FIG. 14 with the imprinting surface illustrated in a configuration for a file or identification card.

FIG. 16 shows the plurality of photographs (14) on a single sheet of photographic printing paper material (30) of FIG. 14 with the imprinting surface (34) side illustrated and also shown, is the configuration for a file or identification message (50). The lines of separation (56) between each of the individual photographs (14) are also indicated.

OPERATION—FIGS. 1 TO 9

The Flow Chart of FIG. 1 illustrates the different steps for the method for printing photographic cards using computer operator (18) input to software (20) for writing and editing messages which are processed by the computer (22) and then sent to the printer (24). A photograph (14) is taken using one of a plurality of different types of cameras, of the subject or object (10) of the Photographic card. The preferred embodiment of the continuous form configuration of photographs (14) is shown loaded (16) into the printer (24) with the subject/object (10) illustrated and the completed photographic cards (26) are shown exiting the printer with the imprinted message illustrated. The message is written by the computer operator (18) with currently available desk top publishing, word processing, database or spreadsheet types of computer software (20), which is processed by a computer (22) which in turn controls the printer (24).

Figure 18:
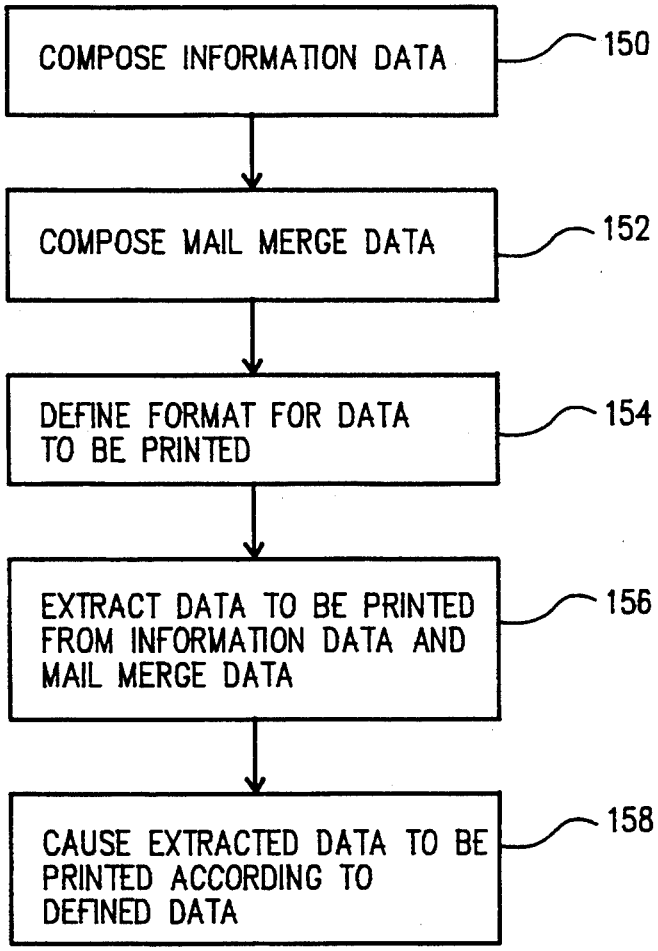
FIG. 18 is a flow chart of a program for implementing the claimed method with the preferred embodiment of the computer and printer system shown in FIG. 17.

FIG. 18 is a flow chart of a program for implementing the claimed method with the preferred embodiment of the computer and printer system shown in FIG. 17. A first step, shown in block 150, is to compose the information data from which the data to be printed on the non-photographic side of the photographic printing paper is chosen. For example, the information data can include a description of the images in the photograph printed on the photographic side of the photographic printing paper, a general information portion, and proprietary notices, such as copyright and trademark notices.

Next, the program can include a step, shown in block 152, to compose mail merge data, such as individual names and addresses to which the photocards are to be sent. The steps shown in blocks 150 and 152 can be performed in any desired order.

Following the steps in blocks 150 and 152, the user of the computer and printing system 120 can define the format for the data to be printed on the photocards (block 154). This can be done conventionally by use of templates generated under Word for Windows. After the format definition step, the data to be printed can be extracted from the information data and the mail merge data (block 156). This is also a conventional feature of Word for Windows.

Finally, the step of causing the extracted data to be printed is performed (block 158). The extracted data are printed according to the format defined in the step shown in block 154, and is conventionally performed by Word for Windows, which causes the transmittal of the data from the computer 122 to the printer 124 over the cable 126.

The method of using the preferred embodiment of the photographic cards of FIGS. 2 to 6 with the perforations (42) between the photographic cards and the tractor feed selvedge strips (35), is to load the photographic cards into a printer using the tractor feed mechanisms in the printer. This method offers exact registration and control of the photographs (14) while the message is being printed on the imprinting surface (34) of the photographic card. This method also positively eliminates any possibility of slippage of the photograph (14) while it is being printed.

The method of using the photographic card in FIGS. 8 to 10 is to load the singular photograph into a printer either manually or with the use of a sheet feeder mechanism and print the message on the imprinting surface (34) of the photograph (14).

The method of using the plurality of photographic cards in continuous form as shown in FIGS. 11 to 13 is to load the roll of continuous form photographs (14) in the printer so that the printer platen mechanism will advance the photographs (14) as they are printed. The roll of continuous form photographs (14) should be supported in such fashion as to eliminate any resistance to the printer feed mechanism. The photographs included with this patent application clearly illustrate one means for accomplishing this support.

The method of lining the embodiment of FIGS. 14 to 16 is to load a sheet of a plurality of photographs (14) into a printer using a plurality of methods including loading manually by hand, loading manually with a manual sheet feeder and loading with an automatic sheet feeder.

RAMIFICATIONS AND SCOPE

Accordingly the reader will see that the photographic card of this invention and the method for making the photographic cards, will provide many advantages over prior art, particularly the labor saving feature of eliminating assembly procedures as required in all of the prior art, by printing a message directly on the reverse side of a photograph. The photographic cards can be used as postcards for advertising and other purposes, for personal greeting cards and for identification and file cards for all types of applications. As previously noted, the photographic cards of this invention can be used for any conceivable application whereby it would be advantageous to print a message directly on the back of a photograph.

Although the description above contains many specificities, these should not be construed as limiting the scope oft he invention but as merely providing illustrations of some of the presently preferred embodiments of this invention. For example, the photographs can be of any subject, in black and white or in color and the sizes of the photographs although not specified, can be any of the standard postcard or standard photograph sizes or even non-standard sizes if so desired.

Various modifications and variations to the embodiments herein chosen for purposes of illustration, will readily occur to those skilled in the art. To the extent that such variations and modifications do not depart from the spirit of the invention, they are intended to be included within the scope thereof which is assessed only by a fair interpretation of the following claims. Thus the scope of the invention should be determined by the appended claims and their legal equivalents, rather than by the examples given.

Having fully described and disclosed the method and the preferred embodiment and alternative embodiments of the material of this invention thereof in such clear and concise terms as to enable those skilled in the art to understand and practice the same, I claim:

1. A method of making photographic cards comprising the steps of:

storing a plurality of information data in data storage means;

loading a plurality of connected pre-printed photographs into a laser printing means, at least one of the plurality of connected pre-printed photographs having a back; and processing said plurality of information data such that at least some of said plurality of information data is printed by said laser printing means over substantially all portions of a back of at least one of said plurality of connected pre-printed photographs.

2. The method of claim 1 further comprising the step of:

separating each of said connected pre-printed photographs.

3. The method of claim 1 wherein said pre-printed photographs are connected by perforations.

4. The method of claim 1 wherein said pre-printed photographs are connected in a roll configuration.

5. The method of claim 1 wherein said pre-printed photographs are connected in a sheet configuration.

6. The method of claim 1 wherein said connected pre-printed photographs have a strip on each side of said photographs, said strips each having a plurality of holes therein adapted to mate with corresponding roller pins of said laser printing means such that said strips facilitate feeding of said connected pre-printed postcards into said laser printing means.

7. The method of claim 6 wherein said strips are each removably connected by perforations to said connected pre-printed photographs.

8. An apparatus for making photographic cards comprising:

data storage means for storing a plurality of information data;

card stock consisting of a plurality of connected pre-printed photographs adapted to be fed into a laser printing means, at least one of the plurality of said connected pre-printed photographs having a back;

laser printing means for printing said plurality of information data onto said stock; and processing means for processing said plurality of information data and controlling said laser printing means such that at least some of said plurality of information data is printed by said laser printing means over substantially all portions of a back of at least one of said connected pre-printed photographs.

9. The apparatus of claim 8 wherein said pre-printed photographs are connected by perforations.

10. The apparatus of claim 8 wherein said pre-printed photographs are connected in a roll configuration.

11. The apparatus of claim 8 wherein said pre-printed photographs are connected in a sheet configuration.

12. The apparatus of claim 8 wherein said connected pre-printed photographs are further comprised of a strip on each side of said photographs, said strips each having a plurality of holes therein adapted to mate with corresponding roller pins of said laser printing means such that said strips facilitate feeding of said connected pre-printed photographs into said laser printing means.

13. The apparatus of claim 12 wherein said strips are each removably connected by perforations to said connected pre-printed photographs.

14. Card stock for making photographic cards by employing data storage means for storing a plurality of information data, laser printer means for printing the plurality of information data onto the card stock, and processing means for processing the plurality of information data and controlling the laser printer means, said card stock comprising:

a plurality of connected pre-printed photographs each having a back and adapted to be fed into the laser printer means such that at least some of the information data is printed by the laser printer means over substantially all portions of said back of at least one of the plurality of said connected pre-printed photographs upon processing by the processing means, said plurality of connected pre-printed photographs adapted to be subsequently separated.

15. The card stock of claim 14 wherein said pre-printed photographs are connected by perforations.

16. The card stock of claim 14 wherein said pre-printed photographs are connected in a roll configuration.

17. The card stock of claim 14 wherein said pre-printed photographs are connected in a sheet configuration.

18. The card stock of claim 14 wherein said connected pre-printed photographs are further comprised of a strip on each side of said photographs, said strips each having a plurality of holes therein adapted to mate with corresponding roller pins of said laser printer means such that said strips facilitate feeding of said connected pre-printed photographs into said laser printer means.

19. The card stock of claim 18 wherein said strips are each removably connected by perforations to said connected pre-printed photographs.

* * * * *